US011753807B2

(12) United States Patent
Fan et al.

(10) Patent No.: US 11,753,807 B2
(45) Date of Patent: Sep. 12, 2023

(54) TOILET BOWL FLUSH DEVICE

(71) Applicant: Lixil (China) Investment Co., Ltd., Shanghai (CN)

(72) Inventors: Zhongde Fan, Shanghai (CN); Li Jiang, Shanghai (CN); Tiantao Li, Shanghai (CN); Yongze Liu, Shanghai (CN); Xiaolong He, Shanghai (CN)

(73) Assignee: LIXIL (China) Investment Co., Ltd, Shanghai (CN)

( * ) Notice: Subject to any disclaimer, the term of this patent is extended or adjusted under 35 U.S.C. 154(b) by 135 days.

(21) Appl. No.: 17/362,237

(22) Filed: Jun. 29, 2021

(65) Prior Publication Data

US 2021/0404159 A1 Dec. 30, 2021

(30) Foreign Application Priority Data

Jun. 30, 2020 (CN) ..... 202021247054.5

(51) Int. Cl.
*E03D 1/26* (2006.01)
*E03D 1/38* (2006.01)

(52) U.S. Cl.
CPC ..... *E03D 1/263* (2013.01); *E03D 1/38* (2013.01)

(58) Field of Classification Search
CPC ..... E03D 1/263; E03D 1/266; E03D 1/38; E03D 2201/30
See application file for complete search history.

(56) References Cited

U.S. PATENT DOCUMENTS 597,499 A * 1/1898 Harvey ..... E03D 1/266 4/344
1,939,118 A * 12/1933 Hinsdale ..... E03D 1/266 137/262

(Continued)

FOREIGN PATENT DOCUMENTS

CN 105888009 * 8/2016 ..... E03D 3/06

*Primary Examiner* — J C Jacyna
(74) *Attorney, Agent, or Firm* — Tyler A. Stevenson; Anna-lisa L. Gallo

(57) ABSTRACT

The present utility model relates to the field of manufacture of sanitary wares, and provides a toilet. The toilet includes a seat body with a sewage accommodating bowl, and a cistern. The inside of the cistern is provided with a fill valve, a first ring flushing pipeline, a first water inlet end of the first ring flushing pipeline is selectively in fluid communication with the fill valve, a first water outlet end of the first ring flushing pipeline is in fluid communication with a ring flushing port opening, and the first ring flushing pipeline includes a first jet flow increasing structure; a second bottom flushing pipeline, a second water inlet end of the second bottom flushing pipeline is selectively in fluid communication with the fill valve, and the second bottom flushing pipeline includes a second jet flow increasing structure; and a pipeline switching mechanism, being able to automatically switch the fluid communication between the first ring flushing pipeline and the fill valve or between the second bottom flushing pipeline and the fill valve in response to a water level in the cistern. By using such toilet, the sewage accommodating bowl can be more cleanly and thoroughly flushed with the same water consumption, or a low-profile cistern design can be realized under the same water pressure requirement.

15 Claims, 5 Drawing Sheets

(56) References Cited

U.S. PATENT DOCUMENTS

| | | | | |
|---|---|---|---|---|
| 3,336,602 | A * | 8/1967 | Kubit | E03D 1/266 4/301 |
| 2006/0096017 | A1* | 5/2006 | Yamasaki | G01F 23/00 4/420 |
| 2007/0061955 | A1* | 3/2007 | Asada | E03D 11/08 4/425 |
| 2010/0299824 | A1* | 12/2010 | Vargas | E03D 5/024 4/431 |
| 2016/0002903 | A1* | 1/2016 | Grover | E03D 11/08 4/405 |
| 2018/0016777 | A1* | 1/2018 | Xie | E03D 1/306 |
| 2020/0002928 | A1* | 1/2020 | Kuroki | E03D 9/00 |

* cited by examiner

A-A

B-B

TOILET BOWL FLUSH DEVICE

TECHNICAL FIELD

The present utility model relates to the field of manufacture of sanitary wares, and mainly relates to a toilet. The toilet can realize independent two-path flushing of a sewage accommodating bowl so as to respectively perform ring flushing and bottom flushing.

BACKGROUND ART

For a long time, more and more users replace traditional direct-flushing type toilets with siphon type toilets. The siphon type toilets have the advantages of stronger flushing force, quieter effect and better odor isolation effect. The siphon type toilets may further be classified into vortex type siphon toilets and jet type siphon toilets. For example, the jet type siphon toilet adopts a siphon principle in hydrodynamics, after a flushing device is started, a toilet pipeline is in a vacuum state, a strong negative pressure is instantly generated in a sewage discharging pipeline, and due to the effect of atmospheric pressure, a liquid column height difference (i.e., pressure difference) is formed, so that water flows from a high water level with a greater pressure to a low water level with a smaller pressure, and fully fills the sewage discharging pipe to generate a so-called siphon phenomenon and further suck away the sewage.

An existing siphon type toilet mostly includes a flushing ring positioned at the top of a sewage accommodating pan of the toilet and a jet hole positioned in the bottom of the sewage accommodating pan of the toilet, the water flowing out from the flushing ring at the top is used for flushing the sewage accommodating surface of the toilet, the water flowing out from the jet hole is used for jetting the sewage at the bottom of the sewage accommodating pan of the toilet so as to generate a siphon effect and flush the sewage in the toilet pan into a sewage discharging elbow.

Therefore, one path of water discharged from a flush assembly of a cistern of the toilet flows to multiple positions of an upper edge of an inner wall of the sewage accommodating pan to flush the sewage accommodating surface from top to bottom, and the other path of water flows to the bottom of the sewage accommodating pan of the toilet to perform siphon type flushing on the sewage at the bottom.

However, such existing design has the defects that sometimes, the volume of water for flushing is small since the water level in the cistern of the toilet is low or the volume of the cistern is small, this may cause a low water pressure in the cistern, the water pressure of water for flushing the sewage accommodating surface at the upper edge of the inner wall of the sewage accommodating pan of the toilet (i.e., ring flushing) is low, and finally the toilet flushing is unthorough and unclean, causing inconvenience to the life of a user.

Therefore, there is a constant need in the field of toilets to ensure the satisfaction of clean and thorough flushing requirement of the toilet at a low water pressure or small water volume in the cistern.

SUMMARY OF THE UTILITY MODEL

Aiming at the above technical problems, the present utility model provides an improved toilet which achieves an obvious pressurization effect, realizes cleaner and more thorough flushing on a sewage accommodating bowl of the toilet, can reduce water consumption to a certain degree at the same time, is simple and feasible, achieves an obvious effect and makes a miniaturization design of a cistern possible.

The present utility model provides a toilet. The toilet includes a seat body with a sewage accommodating bowl, and a cistern. The sewage accommodating bowl includes a sewage accommodating surface and a sewage draining exit positioned at the bowl bottom, and is provided with a ring flushing port opening. The cistern accommodates water for flushing the sewage accommodating bowl. The inside of the cistern is provided with a fill valve, where water flows into the cistern through the fill valve; a first ring flushing pipeline, where a first water inlet end of the first ring flushing pipeline is selectively in fluid communication with the fill valve, a first water outlet end of the first ring flushing pipeline is in fluid communication with the ring flushing port opening so as to perform ring flushing on the sewage accommodating bowl, the first ring flushing pipeline includes a first jet flow increasing structure, and the first jet flow increasing structure is configured to be able to generate a negative pressure when water from the fill valve flows through the first jet flow increasing structure so as to suck water in the cistern into the first ring flushing pipeline; a second bottom flushing pipeline, where a second water inlet end of the second bottom flushing pipeline is selectively in fluid communication with the fill valve, and the second bottom flushing pipeline includes a second jet flow increasing structure, the second jet flow increasing structure is configured to be able to generate a negative pressure when water from the fill valve flows through the second jet flow increasing structure so as to suck water in the cistern into the second bottom flushing pipeline; and a pipeline switching mechanism, configured to be able to automatically switch the fluid communication between the first ring flushing pipeline and the fill valve or between the second bottom flushing pipeline and the fill valve in response to a water level in the cistern.

Therefore, by using a design of double jet flow increasing structures, the sewage accommodating bowl can be more cleanly and thoroughly flushed with the same water consumption, or a low-profile cistern design can be realized under the same water pressure requirement. Additionally, the pipeline switching mechanism switches according to a water level, the time of switching ring flushing and bottom flushing (for example, by an additional controller and the like) does not need to be set in advance, and the structure of the mechanism is simpler.

Preferably, a flush valve is further disposed in the cistern, a second water outlet end of the second bottom flushing pipeline is in fluid communication with the flush valve so as to enable water to flow to the sewage draining exit through the flush valve to perform bottom flushing on the sewage accommodating bowl. Water of the second bottom flushing pipeline can flow to the sewage draining exit through the flush valve to perform bottom flushing, and at the same time, the closing of the bottom flushing process can be controlled by the flush valve.

For example, the first jet flow increasing structure may include a first spray nozzle near the first water inlet end, a first throat pipe near the first water outlet end, and a first gap positioned between the first spray nozzle and the first throat pipe; and the first jet flow increasing structure is configured to generate a negative pressure when the water from the fill valve flows through the first gap, so that the water in the cistern accordingly flows into the first throat pipe.

By using the first jet flow increasing structure, a stronger water flow can be generated so as to more thoroughly perform ring flushing on the sewage accommodating bowl, the water consumption required is lower, and the miniaturization of the cistern is facilitated.

For another example, the second jet flow increasing structure may include a second spray nozzle near the second water inlet end, a second throat pipe near the second water outlet end, and a second gap positioned between the second spray nozzle and the second throat pipe; and the second jet flow increasing structure is configured to generate a negative pressure when the water from the fill valve flows through the second gap, so that the water in the cistern accordingly flows into the second throat pipe.

Similarly, by using the second jet flow increasing structure, a stronger water flow can be generated so as to provide a greater water volume in a short time during bottom flushing on the sewage accommodating bowl, thus achieving more thorough flushing.

Favorably, the pipeline switching mechanism can be configured to be able to switch a first position for fluid communication between the first ring flushing pipeline and the fill valve to a second position for fluid communication between the second bottom flushing pipeline and the fill valve in response to water level reduction in the cistern.

By using a design of the pipeline switching mechanism, the ring flushing can be switched into bottom flushing by one operation step when the water level is reduced, and the structure is very simple and reliable.

In some embodiments, the pipeline switching mechanism, for example, may include a floater type actuating device and a switching valve, and the floater type actuating device drives the switching valve to switch between the first position and the second position in response to a water level.

Through the floater type actuating device, an actuating response effect according to the water level can be achieved by a simple mechanism.

More favorably, the switching valve can be disposed in a T-junction, and the fill valve, the first water inlet end of the first ring flushing pipeline and the second water inlet end of the second bottom flushing pipeline are respectively connected to the T-junction. By using the T-junction, switching on the water from the fill valve between ring flushing and bottom flushing can be achieved by a compact structure.

Additionally, the second throat pipe is configured to be capable of being aligned with the second spray nozzle. Particularly, a direction changing mechanism is further disposed in the cistern, and is configured to allow a jet water flow sprayed out from the second spray nozzle to be directly injected into the cistern instead of flowing into the second throat pipe when the water level in the cistern is lower than a first preset water level.

By using the direction changing mechanism, the water from the fill valve directly flows into other positions in the cistern, so that the water level in the cistern can fast is raised in a very short time, the water feeding efficiency is improved, and the user experience is better.

Particularly, a closing mechanism configured to close the flush valve is further disposed in the cistern, and is configured to close the flush valve when the water level in the cistern is lower than a second preset water level.

By using the closing mechanism, the goal of closing the flush valve when the water level is lower than the preset water level can be achieved, and the situation that the flush valve can be closed only after the floater type actuating device ascends in place is avoided, so that the whole operation efficiency is improved, and the user experience is improved.

Additionally, the toilet may further include a flushing switch operated by a user, and the flushing switch is linked to a flushing actuating device positioned in the cistern, such that the flushing actuating device is able to open the fill valve and the flush valve when being actuated by the flushing switch.

By using the flushing actuating device, the fill valve and the flush valve can be controlled to opened simultaneously or sequentially, the flexible water feeding and discharge operation and the reliable bottom flushing process can be achieved, and the response speed is high.

LIST OF NUMERALS

100 toilet;
110 seat body;
112 sewage accommodating bowl;
114 sewage accommodating surface;
115 sewage draining exit;
116 water guide path;
117 ring flushing port opening;
119 inner edge portion;
120 cistern;
120*a* cistern front inner wall;
120*b* cistern rear inner wall;
122 fill valve;
124 first ring flushing pipeline;
124*a* first spray nozzle;
124*b* first gap;
124*c* first throat pipe;
124*d* first water outlet end;
126 second bottom flushing pipeline;
126*a* second spray nozzle;
126*b* second gap;
126*c* second throat pipe;
128 flush valve;
128*a* overflow pipe;
129 floater type actuating device;
129*a* floater element;
129*b* connecting element;

129*c* pivoting point;
130 switching valve;
160 flushing actuating device;
161 spring;
162 support rod;
163 sliding rod;
164 rack portion;
165 gear;
166 triggering portion; and
167 chain.

DETAILED DESCRIPTION OF THE UTILITY MODEL

It should be noted that the reference drawings are not all drawn to scale, but may be expanded to illustrate various aspects of the present utility model, and in this regard, the drawings should not be construed as limiting In the present utility model, the term "toilet" refers to a whole cleaning system for toilet flushing, for example, including a seat body provided with a sewage accommodating bowl, a toilet lid (particularly an intelligent toilet lid), a toilet cistern, various pipelines, electric wires, connectors, accessories, etc. It could be understood that the types of the toilet of the present utility model are not limited, and intelligent toilets, siphon type toilets and various traditional toilets are all within the range of the present utility model.

Figure 1:
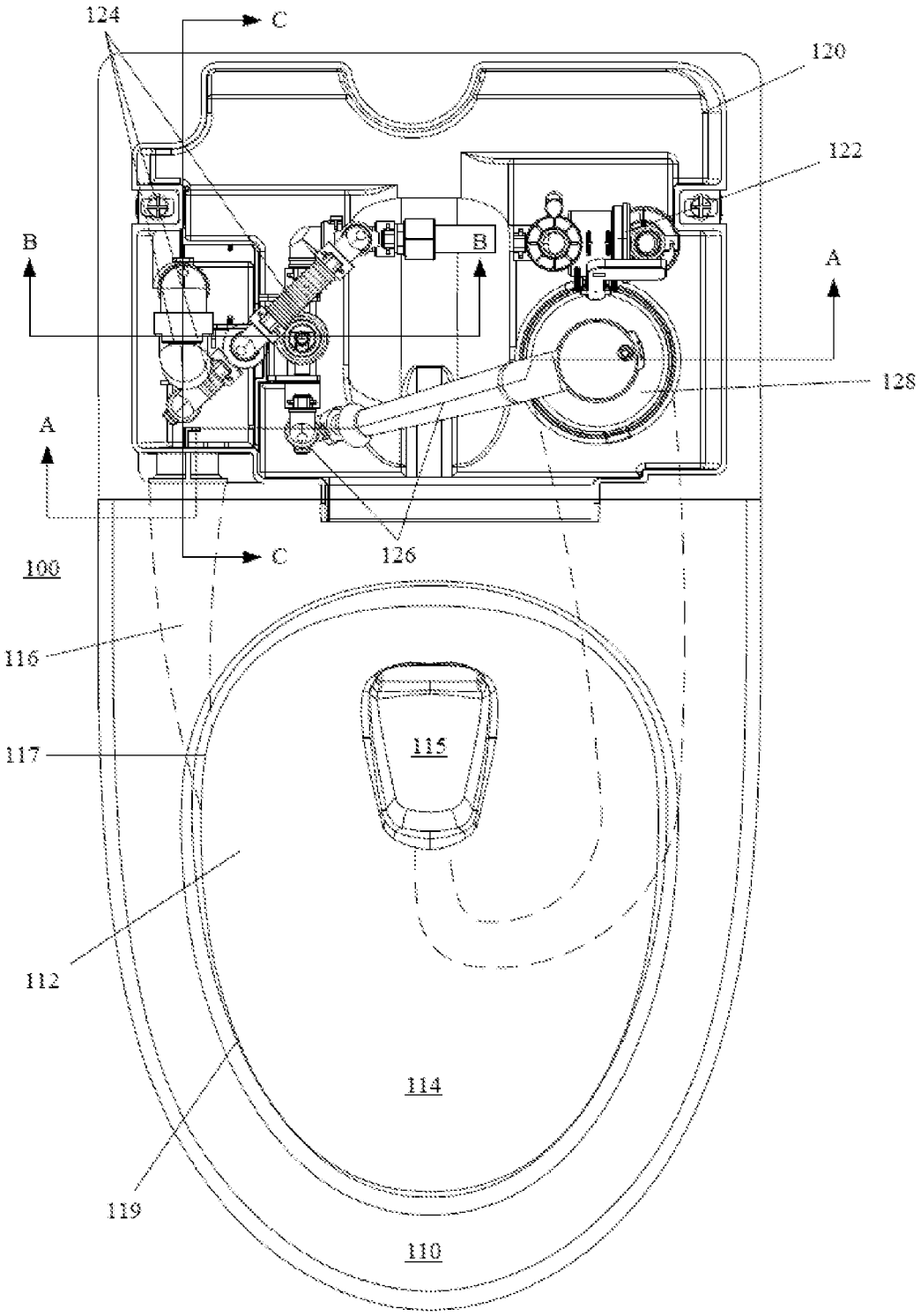
FIG. 1 illustratively shows a top view of an inner structure of a cistern according to an embodiment of the present utility model, with a fill valve, a flush valve, a first ring flushing pipeline and a second bottom flushing pipeline shown therein.

As shown in FIG. 1, a toilet 100 of the present utility model includes a seat body 110, for example a seat body 110 made of ceramics. In a solution of a wall-mounted type toilet, a rear portion of the seat body 110 may be directly abutted against a wall surface on which the seat body is expected to be disposed. In a solution of a non-wall-mounted type toilet, a rear portion of the seat body 110 may be disposed at a certain distance away from the wall surface. A toilet lid may be directly disposed above the seat body 110 of the toilet body 100, and the toilet lid may be an intelligent toilet lid, i.e., can provide a private part cleaning function, a drying function, a disinfection function, and the like for a user according to requirements.

The seat body 110 is provided with a sewage accommodating bowl 112 (or called as a sewage containing pan), the sewage accommodating bowl 112 has a proper size and shape, facilitating use by a user. The sewage accommodating bowl 112 generally includes a sewage accommodating surface 114 and a sewage draining exit 115 positioned at the bowl bottom. It can be understood that the sewage accommodating surface 114 (also called as a sewage accommodating bowl inner wall or sewage collecting surface) downwards extends and gathers to the sewage draining exit 115 from the top of the sewage accommodating bowl 112.

An inner edge portion 119 positioned at an upper portion of the sewage accommodating bowl 112, and a water guide path 116 connected with the inner edge portion 119 and the cistern are further disposed on the seat body 110. The inner edge portion 119 becomes a flow path for achieving rotary flowing of water supplied to the sewage accommodating bowl 112, and the inner edge portion 119 is formed as an approximately annular (top view) flow path surrounding the upper edge of the sewage accommodating bowl 112 for a circle. In order to achieve the ring flushing function, an end portion at a downstream side of the water guide path 116 is provided with an opening at the inner edge portion 119 (for example, an opening is formed in a left side portion of the inner edge portion 119), the opening is a ring flushing port opening 117, and is used as a water exit, and when the water is supplied to the water guide path 116 from the cistern 120, the water is sprayed out from the ring flushing port opening 117 and supplied to the inner edge portion 119, and is used as flushing water for cleanly cleaning the sewage accommodating surface 114, as most clearly shown in FIG. 1.

The water in the water guide path 116 flushes the sewage accommodating surface 114 from top to bottom through the ring flushing port opening 117, so as to sufficiently clean the sewage accommodating surface 114 without a dead corner. Alternatively, the ring flushing port opening 117 of the present utility model can be directly formed in the sewage accommodating surface 114, for example, in any proper position of the sewage accommodating surface 114 from the top to the bottom of the sewage accommodating bowl 112.

Additionally, preferably, the structure of the sewage accommodating surface 114 is set to be a structure favorable for water flow rotation, so that the water flowing out from the ring flushing port opening 117 swivels while flushing the sewage accommodating surface 114 from top to bottom, thus cleaning the sewage accommodating surface 114 and the sewage accommodating bowl 112 more thoroughly cleaned.

The toilet 100 according to the present utility model includes a cistern 120 whose specific structure and form are not limited, and any storage equipment for storing water for flushing the toilet will be within the scope of the present utility model. For example, the cistern 120 is generally disposed in a position behind the seat body 110 of the toilet 100 and near the wall surface, but other positions relative to the seat body 110 are not excluded. Additionally, the cistern 120 may be in various optional models for the volume, including the small-size low-profile cistern, but may also be a traditional cistern with a height a little lower than a height of an opened toilet lid.

In the present utility model, although various components (for example, a fill assembly, a flush assembly, a flushing pipeline and the like described in detail hereafter) are described in a mode of "disposed in the cistern", but the cases that some of these components or a part of these components are positioned outside a cistern body of the cistern 120 are not excluded. For example, although the first ring flushing pipeline 124, the second bottom flushing pipeline 126 and the pipeline switching mechanism are described as being disposed in the cistern 120, the cases that a part of the flushing pipeline or some components of the pipeline switching mechanism are positioned outside the cistern 120 are not excluded. For example, a part of the flushing pipeline may directly extend from the cistern 120 to the inside of the seat body 110 of the toilet 100 or extends in other structures between the cistern 120 and the seat body 110.

For the toilet 100, a common water supply source is water (tap water) in a water supply pipe network. According to the present utility model, the inside of the cistern 120 is firstly provided with the fill assembly, the fill assembly includes a fill valve 122, and the fill valve 122 is configured to control whether the water from the water supply source to enter the cistern 120 or not. The fill valve 122 can be controlled to determine whether to fill water or not according to the water level in the cistern 120, can also be directly operated to be opened by a user, and can be closed after the water level exceeds a preset height so as to prevent excessive water fill.

In order to achieve the ring flushing of the toilet 100, as shown in FIG. 1, the toilet 100 includes a first ring flushing pipeline 124 disposed in the cistern 120. As mentioned above, a part of the first ring flushing pipeline 124 may be disposed outside the cistern 120, but a main body portion of the first ring flushing pipeline should be positioned in the cistern 120. The first ring flushing pipeline 124 includes a first water inlet end, a first water outlet end 124*d* and a pipeline extending therebetween. Specifically, the first ring flushing pipeline 124 is in fluid communication with the fill valve 122 in the cistern 120 through the first water inlet end thereof, so that water entering the cistern through the fill valve 122 can flow into the first ring flushing pipeline 124 from the first water inlet end. The first ring flushing pipeline 124 is in fluid communication with the ring flushing port opening 117 formed in the seat body 110 of the toilet 100 through the first water outlet end 124*d* thereof (for example, see FIG. 4), so that water in the first ring flushing pipeline 124 can flow to the ring flushing port opening 117 so as to flush the sewage accommodating surface 114 of the sewage accommodating bowl 112 through the ring flushing port opening (i.e., the ring flushing).

However, it can be understood that the present utility model does not exclude the case that an intermediate fluid element (for example, additional pipelines, various fluid valves and the like) are also disposed between the fill valve 122 and the first ring flushing pipeline 124 and/or between the ring flushing port opening 117 and the first ring flushing pipeline 124. For example, as mentioned above, the first water outlet end 124*d* of the first ring flushing pipeline 124 may be in fluid communication with the water guide path 116, so that the water flows to the ring flushing port opening 117 through the water guide path 116.

In order to achieve bottom flushing of the toilet 100, as shown in FIG. 1, the toilet 100 further includes a second bottom flushing pipeline 126. In the present utility model, the terms "first" and "second" do not indicate sequence or priority, and only indicate that these two pipelines are pipelines independent of each other. However, it should be understood that for example, the first ring flushing pipeline 124 and the second bottom flushing pipeline 126 may also gather onto one manifold branch, the manifold branch is, for example, directly connected with the fill valve 122, but this case does not change the fact that the first ring flushing pipeline 124 and the second bottom flushing pipeline 126 are two pipelines independent of each other.

The second bottom flushing pipeline 126 includes a second water inlet end and a second water outlet end. The second bottom flushing pipeline 126 can be in fluid communication with the fill valve 122 through the second water inlet end thereof, so that the water entering the cistern from the fill valve 122 can flow into the second bottom flushing pipeline 126 through the second water inlet end. The second bottom flushing pipeline 126 is configured to supply water to the bottom of the sewage accommodating bowl 112 of a base (i.e., capable of being in fluid communication with the base) so as to perform bottom flushing. The second bottom flushing pipeline 126 can be communicated with the bottom of the sewage accommodating bowl 112 through a fluid valve (which will be described in detail hereafter), but the case that the second bottom flushing pipeline can be directly communicated with the bottom of the sewage accommodating bowl is not excluded.

The statement of "can" be in fluid connection with the fill valve 122 above refers to that the first ring flushing pipeline 124 and the second bottom flushing pipeline 126 can be selectively in fluid communication with the fill valve 122. In other words, the water entering the cistern 120 through the fill valve 122 can flow to the first ring flushing pipeline 124 or the second bottom flushing pipeline 126 according to operations. Preferably, the water flowing through the fill valve 122 does not flow to the first ring flushing pipeline 124 and the second bottom flushing pipeline 126 at the same time, but flows to one of the first ring flushing pipeline 124 and the second bottom flushing pipeline 126. It should be understood that the present utility model does not exclude the case that the water entering the cistern 120 through the fill valve 122 also flows into other pipelines or water storage equipment besides the first ring flushing pipeline 124 and the second bottom flushing pipeline 126.

In order to control the flow division of the feeding water for ring flushing and bottom flushing, the toilet 100 according to the present utility model includes a pipeline switching mechanism so as to conveniently switch between the first ring flushing pipeline 124 and the second bottom flushing pipeline 126, such that the water flows to the first ring flushing pipeline 124 under some conditions, and flows to the second bottom flushing pipeline 126 under some other conditions.

Favorably, the pipeline switching mechanism is configured to be able to automatically switch the fluid communication between the first ring flushing pipeline 124 and the fill valve 122 or between the second bottom flushing pipeline 126 and the fill valve 122 in response to the water level in the cistern 120. In other words, the switching action of the pipeline switching mechanism according to the present utility model is started according to the water level in the cistern 120 instead of being started according to the predetermined time or sequence stored in a controller and the like, so that the operation is convenient and effective.

Specifically, in order to thoroughly flush the sewage accommodating surface 114, preferably, the ring flushing is performed first when the user starts to flush the toilet 100, and then, bottom flushing is performed. Therefore, the pipeline switching mechanism is configured to achieve fluid communication between the fill valve 122 and the first ring flushing pipeline 124 when the water level in the cistern 120 is high, and then achieve the fluid communication between the fill valve 122 and the second bottom flushing pipeline 126 after the water level is reduced to a preset threshold value.

In other words, the pipeline switching mechanism can be preferably configured to be able to switch from a first position of fluid communication between the first ring flushing pipeline 124 and the fill valve 122 to a second position of fluid communication between the second bottom flushing pipeline 126 and the fill valve 122 in response to the water level reduction in the cistern 120.

The operation of performing ring flushing first and then performing bottom flushing has the advantages that during bottom flushing, the water flowing out from the ring flushing port opening 117 during the previous ring flushing has flowed into a water seal at the bottom of the sewage accommodating bowl 112 of the toilet 100, so that the water volume of the water seal at the bottom of the sewage accommodating bowl 112 of the toilet 100 is increased, the siphon can be generated by just a low jet pressure, and the flushing effect of the toilet 100 is improved.

In some embodiments, the pipeline switching mechanism may include a switching valve switching between the first position and the second position. Preferably, the switching valve may be disposed in a T-junction or a multi-way junction, a first end of the T-junction or the multi-way junction is connected with the fill valve 122, a second end is connected with the first ring flushing pipeline 124, and a third end is connected with the second bottom flushing pipeline 126. In the first position, the valve is such switched that the first end and the second end of the junction are communicated, and in the second position, the valve is such switched that the first end and the third end of the junction are communicated. Therefore, the reliable and stable pipeline switching mechanism with a simple structure can be obtained.

In some embodiments, the switching valve may be simply made into a baffle plate. When the pipeline switching mechanism is at the first position, the baffle plate blocks a flow path of the second bottom flushing pipeline 126, for example, the third end in the T-junction or the multi-way junction. When the baffle plate needs to be switched from the first position to the second position, the baffle plate can be pivoted or linearly moved to block a flow path of the first ring flushing pipeline 124 (for example, blocks the second end in the junction) and to expose a position of a flow path to the second bottom flushing pipeline 126. It can be understood that the switching valve can be switched back and forth, and for example, can be automatically restored to the first position when the water level is raised.

In order to actuate such switching valve, the pipeline switching mechanism also favorably includes an actuating device, for example a floater type actuating device 129. The floater type actuating device 129 can vertically move in response to the water level in the cistern 120. Such vertical movement can drive the switching valve or other switching elements to switch between the first position and the second position.

Although the above pipeline switching mechanism is described as that during switching, one switching valve is used to simultaneously cut off the communication of the first ring flushing pipeline 124 and the fill valve 122, and open the communication between the second bottom flushing pipeline 126 and the fill valve 122 or simultaneously cut off the communication between the second bottom flushing pipeline 126 and the fill valve 122 and open the communication between the first ring flushing pipeline 124 and the fill valve 122 again, but two switching elements can be respectively used to switch the first ring flushing pipeline 124 and the second bottom flushing pipeline 126.

For example, the pipeline switching mechanism includes a first pipeline switching mechanism and a second pipeline switching mechanism. The first pipeline switching mechanism is configured to be able to switch between the first position of fluid communication between the first ring flushing pipeline 124 and the fill valve 122 and the second position of no fluid communication between the first ring flushing pipeline 124 and the fill valve 122, and the second pipeline switching mechanism is configured to be able to switch between the first position of fluid communication between the second bottom flushing pipeline 126 and the fill valve 122 and the second position of no fluid communication between the second bottom flushing pipeline 126 and the fill valve 122.

However, under this condition, generally, it is preferable to simultaneously cut off the communication between the first ring flushing pipeline 124 and the fill valve 122 and open the communication between the second bottom flushing pipeline 126 and the fill valve 122, or simultaneously cut off the communication between the second bottom flushing pipeline 126 and the fill valve 122 and open the communication between the first ring flushing pipeline 124 and the fill valve 122 again, or it should at least ensure that the time difference between two operations small enough so as to avoid the stagnation in the flushing process.

Figure 3:
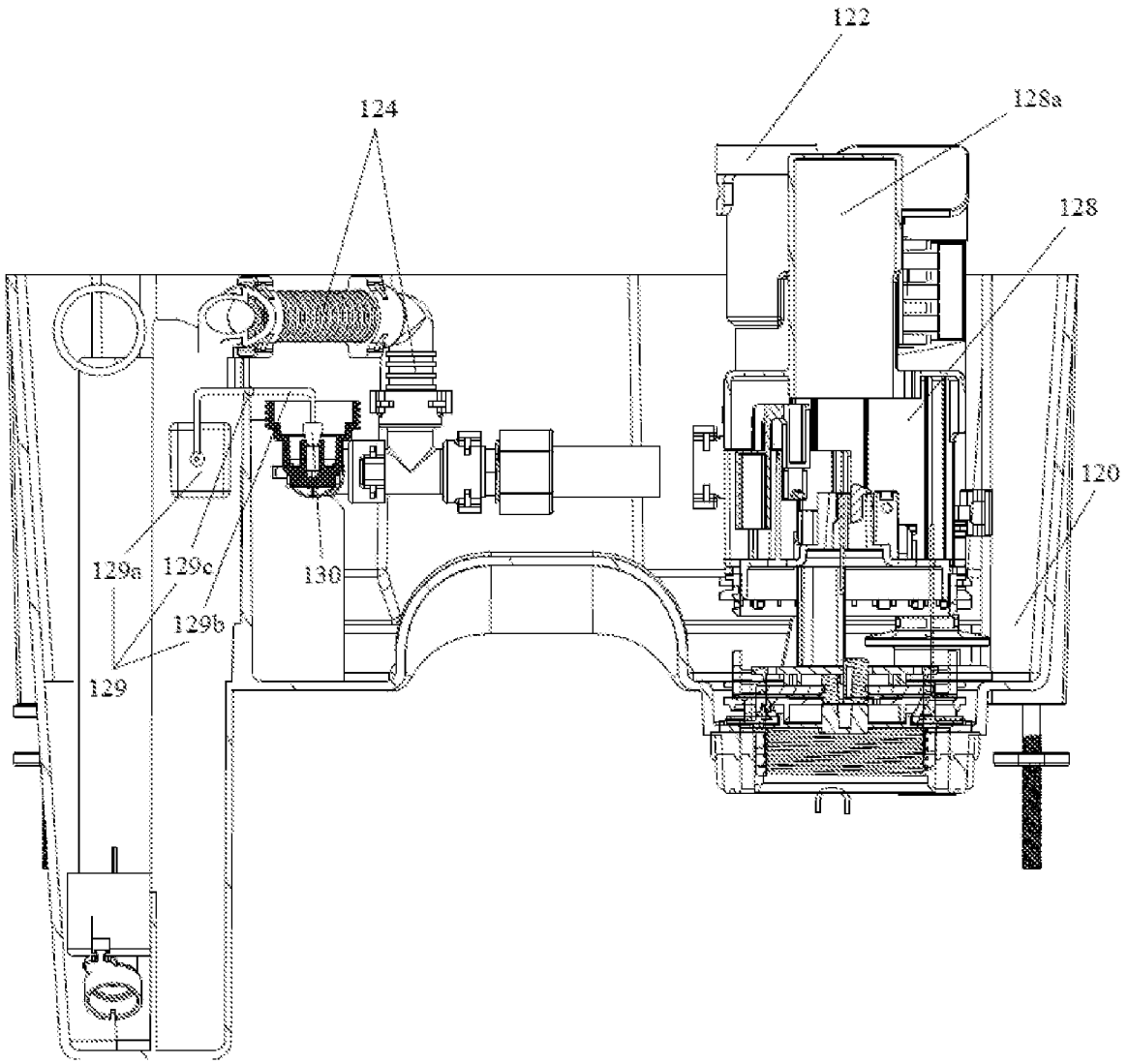
FIG. 3 illustratively shows a sectional view of the inner structure of the cistern according to the embodiment of FIG. 1 along a line B-B, with an example of a floater actuating device shown therein.

In a specific embodiment as shown in FIG. 3, the floater type actuating device 129 of the second pipeline switching mechanism includes a floater element 129*a*, a connecting rod 129*b* is provided between the floater element 129*a* and a switching valve 130, the connecting rod 129*b* includes a pivoting point 129*c*, and acts as a lever. When the water level in the cistern 120 is reduced, the floater element 129*a* positioned at the left side of the pivoting point 129*c* of the connecting rod 129*b* in FIG. 3 accordingly descends. Through the lever effect of the connecting rod 129*b*, the switching valve 130 positioned at the right side is opened (for example, the switching valve 130 can be configured as a blocking element, and due to the lever effect, the blocking element leaves away from a blocking position). Whereby, water of the fill valve 122 can flow to the second bottom flushing pipeline 126. The floater type actuating device of the first pipeline switching device can be linked with the above-mentioned floater type actuating device to close the switching valve 130, but can close the switching valve 130 independently of the floater type actuating device.

In order to achieve a pressure increasing effect to more thoroughly flush the sewage accommodating bowl 112 or save water under the same flushing effect, the two flushing pipelines of the toilet 100 according to the present utility model may further include a jet flow increasing structure (for example, a Venturi structure). In this embodiment, the toilet 100 may also be called as a double-Venturi-structure type toilet 100.

Specifically, the first ring flushing pipeline 124 may include a first jet flow increasing structure. The first jet flow increasing structure is configured to be able to generate a negative pressure when the water (with a certain pressure) from the fill valve 122 flows through the first et flow increasing structure, so that the water in the cistern 120 is sucked into the first ring flushing pipeline 124. It can be understood that the amount of water flowing into the first ring flushing pipeline 124 through the fill valve 122 is very small, and the ring flushing requirement cannot be met, so that a small amount of water from the fill valve 122 generates the negative pressure through the first jet flow increasing structure, and the goal of flushing a great amount of water in the cistern 120 to the ring flushing port opening 117 can be achieved.

Similarly, the second bottom flushing pipeline 126 may also include a second jet flow increasing structure. The second jet flow increasing structure is also configured to be able to generate a negative pressure when the water from the fill valve 122 flows through the second jet flow increasing structure so as to suck the water in the cistern 120 into the second bottom flushing pipeline 126. Its working principle (i.e., using the Venturi effect) is the same as that of the first jet flow increasing structure, and is not repeated herein.

Figure 4:
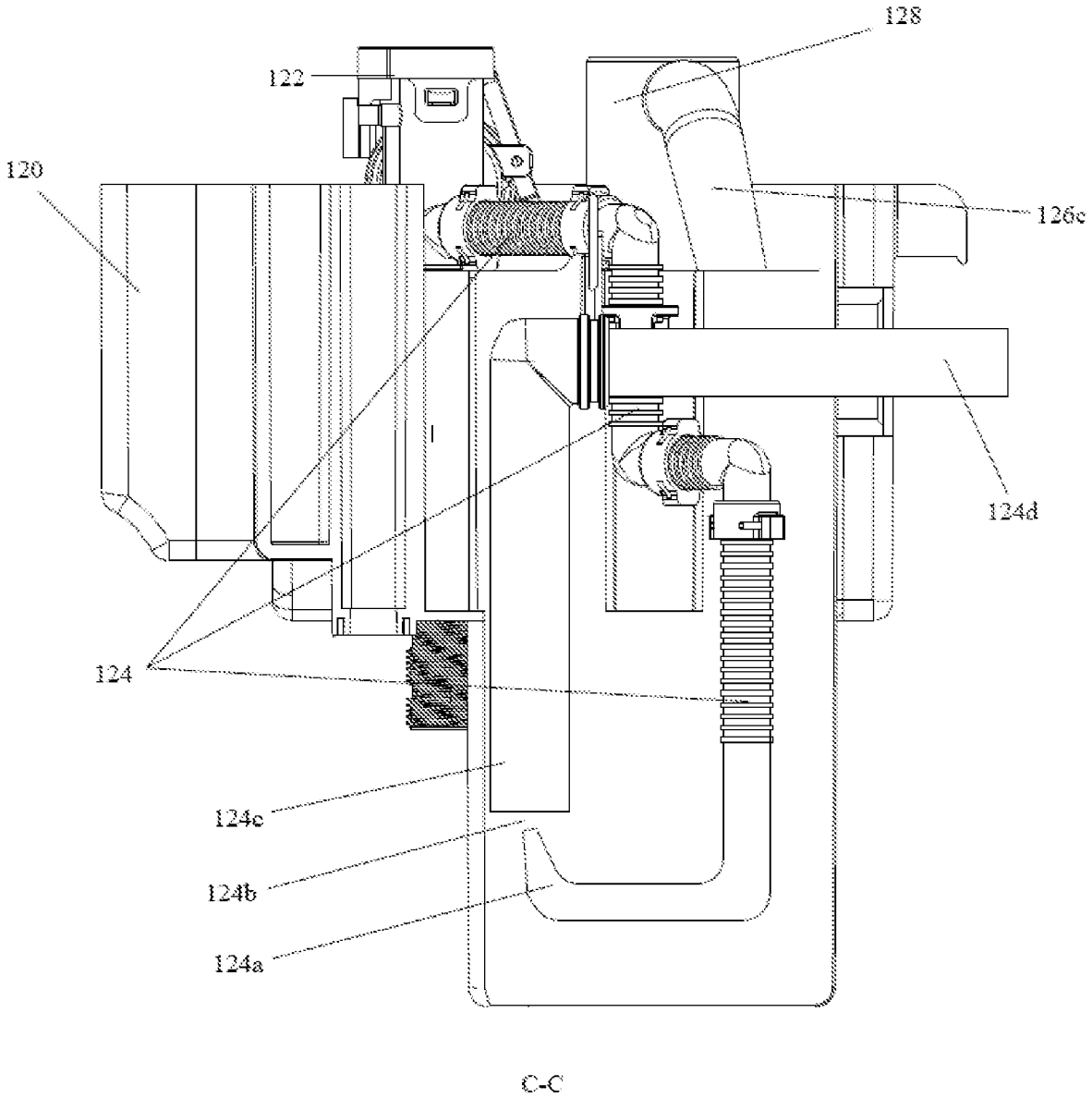
FIG. 4 illustratively shows a sectional view of the structure inside the cistern according to the embodiment of FIG. 1 along a line C-C, with a first jet flow increasing structure of a first ring flushing pipeline and a ring flushing port opening in fluid communication with the first jet flow increasing structure mainly shown therein.

In an embodiment as shown in FIG. 4, the first jet flow increasing structure of the first ring flushing pipeline 124 may include a first spray nozzle 124*a* near the first water inlet end, a first throat pipe 124*c* and a first gap 124*b* positioned between the first spray nozzle 124*a* and the first throat pipe 124*c*. Compared with the first spray nozzle 124*a*, the first throat pipe 124*c* is closer to the first water outlet end 124*d*, and is favorably alignable to the first spray nozzle 124*a*. When the water from the fill valve 122 flows through the first gap 124*b* at a certain pressure, a negative pressure may be generated, so that the water in the cistern 120 flows into the first throat pipe 124*c* along with the water with the pressure, and then flows out from the first water outlet end 124*d* to achieve the jet flow increasing effect. The first jet flow increasing structure may also be called as a jet pump structure or a jet valve structure.

Figure 2:
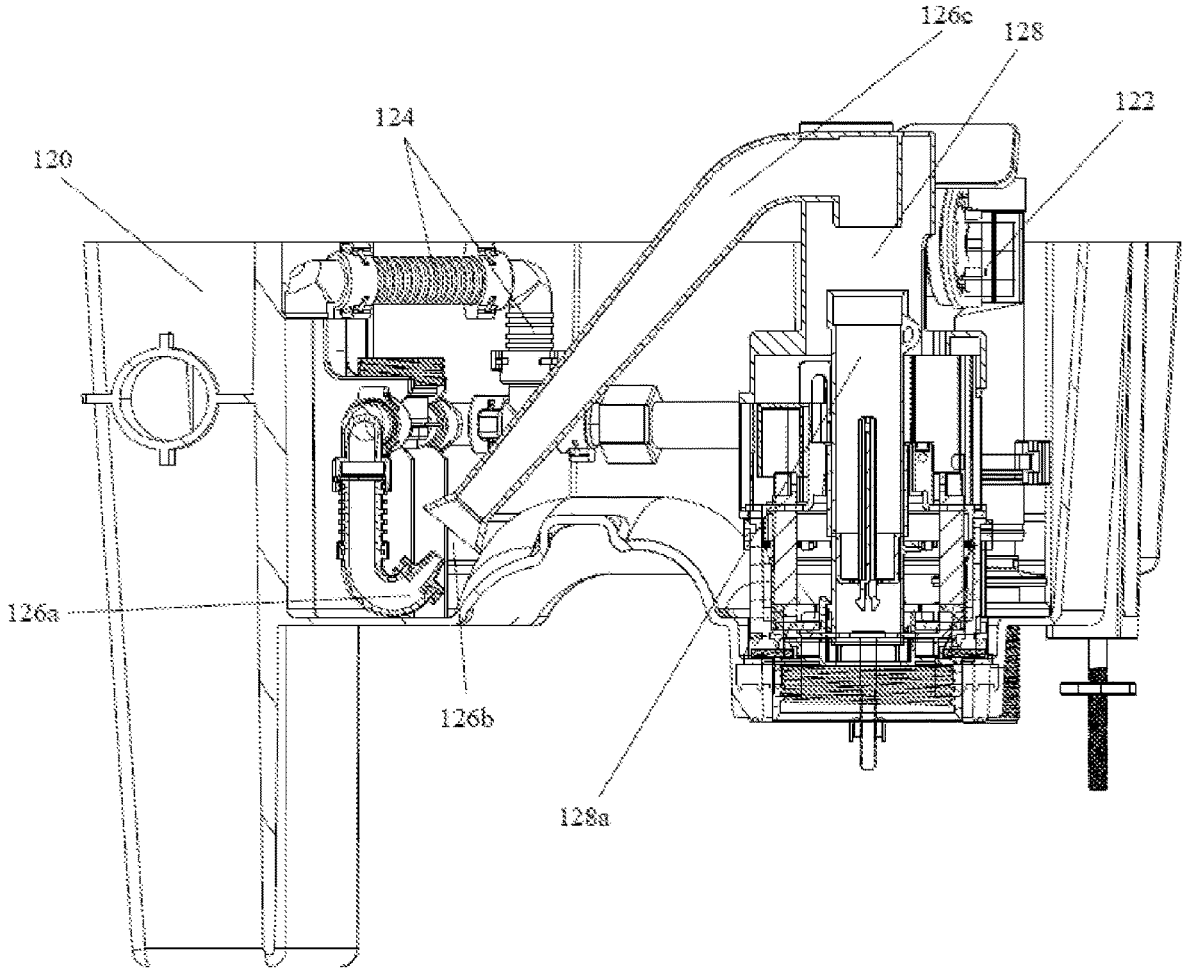
FIG. 2 illustratively shows a sectional view of the inner structure of the cistern according to the embodiment of FIG. 1 along a line A-A, with a second jet flow increasing structure of a second bottom flushing pipeline and a flush valve in fluid communication with the second jet flow increasing structure mainly shown.

Similarly, as clearly shown in FIG. 2, the second jet flow increasing structure of the second bottom flushing pipeline 126 may further include a second spray nozzle 126*a* near the second water inlet end, a second throat pipe 126*c* and a second gap 126*b* positioned between the second spray nozzle 126*a* and the second throat pipe 126*c*. The second throat pipe 126*c* is near the second water outlet end, and is favorably aligned with the second spray nozzle 126*a*. When the water from the fill valve 122 flows through the second gap 126*b* at a certain pressure, a negative pressure can be generated, so that the water in the cistern 120 flows into the second throat pipe 126*c* together with the water with the pressure to achieve the jet flow increasing effect.

Preferably, a direction changing mechanism used for the second jet flow increasing structure may further be disposed in the cistern 120. The second spray nozzle 126*a*, the second gap 126*b* and the portion of the second throat pipe 126*c* near the second gap 126*b* of the second jet flow increasing structure are approximately in the same straight line. The direction changing mechanism may be configured to switch between a work position and a non-work position. In the work position, the direction changing mechanism enables the jet water flow to be basically aligned with the second throat pipe 126*c* and the second spray nozzle 126*a* of the second jet flow increasing structure, so that the jet water flow flows into the second throat pipe 126*c* after being sprayed out from the second spray nozzle 126*a*. When the water level in the cistern 120 is, for example, lower than a first preset water level, the direction changing mechanism switches to the non-work position, the jet water flow can be sprayed out from the second spray nozzle 126*a*, but does not flow into the second throat pipe 126*c*, so that the water from the fill valve 122 directly flows into the cistern 120 from the second spray nozzle 126*a* and does not flow into the second bottom flushing pipeline 126 through the second throat pipe 126*c*. Therefore, the water injection to the cistern 120 can be accelerated, and the water level returns to the initial water level line as fast as possible. For example, the direction changing mechanism may be configured into an adjustable pivoting plate so as to control the specific direction of the jet water flow flowing through the second spray nozzle.

Additionally, the toilet 100 according to the present utility model further includes a flush assembly. The flush assembly includes a flush valve 128 (preferably one flush valve 128). The flush valve 128 is also disposed in the cistern 120. The flush valve 128 controls the water to be able to flow into the seat body 110, mainly into the sewage accommodating bowl 112 through the flush valve.

As clearly shown in FIG. 1 and FIG. 2, the second water outlet end of the second bottom flushing pipeline 126 can be in fluid communication with the flush valve 128, so that the water can flow into a sewage draining exit 115 at the bottom of the sewage accommodating bowl 112 of the seat body 110 from the second bottom flushing pipeline 126 through the flush valve 128, so as to perform bottom flushing on the sewage accommodating bowl 112. For example, the second water outlet end of the second bottom flushing pipeline 126 can be directly communicated with an overflow pipe 128*a* of the flush valve 128, as shown in FIG. 3.

The flush valve 128 of the present utility model may be a flush valve 128 in any form, such as a traditional flush bucket valve and a hydraulic flush valve. The toilet 100 may include a flushing switch directly operated by the user, such as a press key or a knob. In an embodiment of a non-hydraulic flush valve, the flushing switch may be configured to be able to actuate the flushing actuating device 160 to further directly open the flush valve 128 or open both the fill valve 122 and the flush valve 128 when being operated by the user. Therefore, the flushing actuating device 160 should be directly associated with the flushing switch, particularly may be directly connected. By using the flushing actuating device 160, the fill valve and the flush valve can be opened at the same time, or can be sequentially opened.

In an embodiment of the hydraulic flush valve, the flushing switch may be disposed to only open the fill valve 122 when being actuated by the user, and the flush valve 128 is opened according to the water level condition (for example, water level reduction after the ring flushing) in the cistern 120 or is closed again after the water level is reduced to a certain threshold value.

Figure 5:
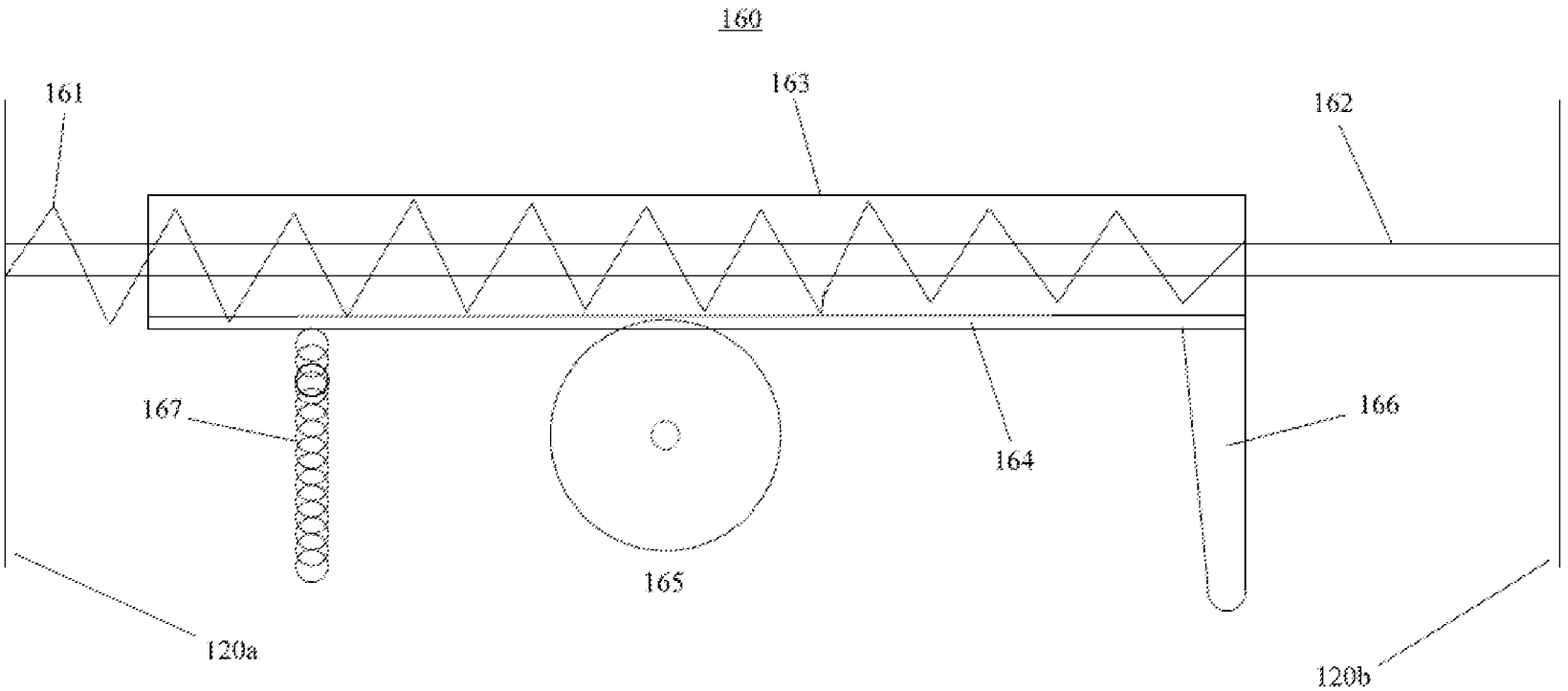
FIG. 5 shows a schematic structural diagram of a flushing actuating device according to an embodiment of the present utility model.

FIG. 5 shows a specific embodiment including the flushing actuating device 160. A support rod 162 is erected between a front inner wall 120*a* and a rear inner wall 120*b* of the cistern 120 (may also be between two opposite inner walls of the cistern 120). A sliding element sleeves the support rod 162, for example, a sliding rod 163 sleeving the support rod 162 as shown in FIG. 5. A spring 161 or other elastic elements may be disposed between the support rod 162 and the sliding rod 163. In a free state, the spring 161 may be in a retracted state. One end of the spring 161 (for example, the left end in FIG. 5) is fixed to any one wall surface of the front inner wall 120*a* and the rear inner wall 120*b*, and the other end (for example, the right end in FIG. 5) is positioned in the sliding rod 163 and is abutted against the tail end surface of the inner side of the sliding rod 163.

The bottom of the sliding rod 163 may form a rack portion 164, a center fixed gear 165 is disposed under the sliding rod 163. For example, the center of the gear 165 may be fixed to any one proper wall surface of the cistern. The gear 165 may be meshed with the rack portion 164 disposed on the sliding rod 163. Of course, a mechanical matching structure between other elements associated with the sliding rod 163 and the flushing switch may also be conceived as long as they can achieve an effect that the flushing switch drives elements positioned in the cistern to move and further drives the sliding rod 163 to transversely move. Therefore, the flushing switch directly operated by the user can control the rotation movement of the gear 165. The gear 165 and the rack portion 164 are meshed, the sliding rod 163 can be driven to move by overcoming the resistance of the spring 161 when the gear 165 rotates.

One end of the sliding rod 163 (for example, the right end in FIG. 5) may be provided with a triggering portion 166 configured to trigger the fill valve 122, the other opposite end of the sliding rod 163 (for example, the left end in FIG. 5) may be connected with an element configured to open the flush valve 128, for example, the other end can be suspended to trigger a chain 167 of the flush valve 128. Therefore, an installing position of the chain 167 on the sliding rod 163 and the located position of the triggering portion 166 may be approximately positioned at the two sides of the gear 165 in a space. Preferably, the position of the gear 165 is basically positioned in a middle portion of the sliding rod 163.

When the user operates the flushing switch to drive the gear 165 to rotate and drive the rack portion 164 to horizontally move, the triggering portion 166 on the sliding rod 163 can reach a set position, and in this set position, the fill valve 122 can be triggered to work. Additionally, due to the horizontal movement of the sliding rod 163, the other end of the chain 167 is connected to the flush valve 128 and thus can achieve the goal of starting the action of the flush valve 128.

Favorably, the flush valve 128 and the fill valve 122 are adjusted to be opened at the same time or opened sequentially with a certain time difference by adjusting the installing position of the chain 167 on the sliding rod 163.

When the flushing is completed, the user can release the flushing switch, under the reset effect of the spring 161, components of the sliding rod 163, the gear 165 and the like can restore to initial positions so as to make a preparation for a next time of toilet 100 flushing function starting by the user.

It can be understood that when the user operates the flushing switch to actuate the flushing actuating device 160 to directly open the flush valve 128, in the ring flushing process performed at first, the flush valve 128 can still maintain an open state. At this moment, most water in the cistern 120 flows to the first ring flushing pipeline 124 (but cannot flow to the second bottom flushing pipeline 126). In other embodiments, the case that a part of water directly flows to the sewage draining exit 115 at the bottom of the sewage accommodating bowl 112 through the flush valve 128 for bottom flushing is not excluded. Under this condition, there is no obvious time sequence between the ring flushing and bottom flushing.

However, it can be understood that the manual actuation on the flushing switch by the user is not necessary, and the flushing switch can be automatically controlled by the toilet 100, especially by the intelligent toilet through a sensing system.

Additionally, according to the present utility model, a closing mechanism configured to close the flush valve 128 may also be disposed in the cistern 120. The structure form of the closing mechanism is not limited as long as the closing mechanism can be configured to close the flush valve 128 when the water level in the water cistern 120 is lower than a second preset water level.

Hereafter, a whole flushing period of the toilet 100 according to an embodiment of the present utility model is illustrated, but it should be understood that this is only exemplary:

First, the user operates the flushing switch. By using the flushing actuating device 160 associated with the flushing switch, the fill valve 122 and the flush valve 128 in the cistern 120 can be opened.

At this moment, the pipeline switching mechanism is positioned at the first position so that the fill valve 122 can be in fluid communication with the first ring flushing pipeline 124, the water can be supplied to the ring flushing port opening 117 of the seat body 110 through the first ring flushing pipeline 124, the water downwards flows to the sewage draining exit 115 at the bottom along the sewage accommodating surface 114 from the ring flushing port opening 117 to achieve the goal of ring flushing.

In this process, the first ring flushing pipeline 124 enables the water in the cistern 120 to flow thereinto through the first jet flow increasing structure thereof, so that the water level in the cistern 120 is reduced.

In response to the water level reduction, the actuating mechanism positioned in the cistern 120 moves (for example, the floater type actuating mechanism 129 descends along with the water level), and then, the switching valve 130 or similar elements are driven to switch from the first position to the second position, so that the fill valve 122 is in fluid communication with the second bottom flushing pipeline 126, and the water is supplied from the second bottom flushing pipeline 126 to the bottom of the sewage accommodating bowl 112 of the seat body 110 for bottom flushing.

In this process, the water can flow into the seat body 110 through the flush valve 128 from the second bottom flushing pipeline 126. The second bottom flushing pipeline 126 enables the water in the cistern 120 to flow thereinto through the second jet flow increasing structure thereof, so that the water level in the cistern 120 is further reduced.

When the water level is reduced to a certain threshold value, the closing mechanism for the flush valve 128 can act to close the flush valve 128, and the water does not flow to the bottom of the sewage accommodating bowl 112 of the seat body 110 through the flush valve 128. During or before or after this process, the direction changing mechanism used for the second jet flow increasing structure of the second bottom flushing pipeline 126 can stop the second jet flow increasing structure, so that the water from the fill valve 122 is directly injected into the cistern 120 from the second spray nozzle 126*a* of the second bottom flushing pipeline 126, so that the water level in the cistern 120 is continuously raised until reaching the initial water level.

When the initial water level is reached, the fill valve 122 in the cistern 120 is closed to stop water fill. When the initial water level is reached, the actuating device of the pipeline switching mechanism moves so as to drive the switching valve 130 to return to the first position from the second position, i.e., return to the cycle starting position to complete one period, waiting for a next flushing operation by the user.

Although various embodiments of the present utility model have been described with the reference to the embodiments of the toilets capable of performing ring flushing and bottom flushing in the drawings, it should be understood that the embodiments in the scope of the present utility model may be applied to sanitary ware equipment with similar structures and/or functions.

Various features and advantages, including various alternative implementations and structure and function details of devices and methods, have been given in the forgoing descriptions. Here, it is intended to be illustrative, not exhaustive or limiting.

It will be apparent to those skilled in the art that various modifications may be made within the full scope indicated by the broad general meaning of the terms expressed in the appended claims, especially in aspects of structures, materials, elements, components, shapes, sizes and arrangement of components, including combinations of these within the principle scopes described herein. To the extent that such various modifications do not depart from the spirit and scope of the appended claims, they are intended to be included herein.

The invention claimed is:

1. A toilet (100), comprising:

a seat body (110) with a sewage accommodating bowl, wherein the sewage accommodating bowl (112) comprises a sewage accommodating surface (114) and a sewage draining exit (115) positioned at the bowl bottom, and is provided with a ring flushing port opening (117); and a cistern (120), accommodating water for flushing the sewage accommodating bowl;

wherein the inside of the cistern (120) is provided with:

a fill valve (122), wherein water flows into the cistern (120) through the fill valve (122);

a first ring flushing pipeline (124), wherein, in a first position, a first water inlet end of the first ring flushing pipeline (124) is selectively in fluid communication with the fill valve (122); a first water outlet end (124*d*) of the first ring flushing pipeline (124) is in fluid communication with the ring flushing port opening (117) so as to perform ring flushing on the sewage accommodating bowl (112); the first ring flushing pipeline (124) comprises a first jet flow increasing structure; and the first jet flow increasing structure is configured to generate a negative pressure when water from the fill valve (122) flows through the first jet flow increasing structure so as to suck the water in the cistern (120) into the first ring flushing pipeline (124);

a second bottom flushing pipeline (126), wherein, in a second position, a second water inlet end of the second bottom flushing pipeline (126) is selectively in fluid communication with the fill valve (122); the second bottom flushing pipeline (126) comprises a second jet flow increasing structure; the second jet flow increasing structure is configured to generate a negative pressure when water from the fill valve (122) flows through the second jet flow increasing structure so as to suck the water in the cistern (120) into the second bottom flushing pipeline (126); and a pipeline switching mechanism configured to automatically switch between the first position and the second position in response to a water level in the cistern (120), wherein the pipeline switching mechanism comprises a floater type actuating device (129) and a switching valve (130), the floater type actuating device configured to drive the switching valve (130) to switch between the first position and the second position.

2. The toilet according to claim 1, wherein, a flush valve (128) is further disposed in the cistern (120), a second water outlet end of the second bottom flushing pipeline (126) is in fluid communication with the flush valve (128) so as to enable water to flow to the sewage draining exit (115) through the flush valve (128) to perform bottom flushing on the sewage accommodating bowl (112).

3. The toilet according to claim 1, wherein, the first jet flow increasing structure comprises a first spray nozzle (124*a*) near the first water inlet end, a first throat pipe (124*c*) near the first water outlet end (124*d*), and a first gap (124*b*) positioned between the first spray nozzle (124*a*) and the first throat pipe (124*c*); and the first jet flow increasing structure is configured to generate a negative pressure when the water from the fill valve (122) flows through the first gap (124*b*), so that the water in the cistern (120) flows into the first throat pipe (124*c*).

4. The toilet according to claim 2, wherein, the second jet flow increasing structure comprises a second spray nozzle (126*a*) near the second water inlet end, a second throat pipe (126*c*) near the second water outlet end, and a second gap (126*b*) positioned between the second spray nozzle (126*a*) and the second throat pipe (126*c*); and the second jet flow increasing structure is configured to generate a negative pressure when the water from the fill valve (122) flows through the second gap (126*b*), so that the water in the cistern (120) flows into the second throat pipe (126*c*).

5. The toilet according to claim 2, wherein, the first jet flow increasing structure comprises a first spray nozzle (124*a*) near the first water inlet end, a first throat pipe (124*c*) near the first water outlet end (124*d*), and a first gap (124*b*) positioned between the first spray nozzle (124*a*) and the first throat pipe (124*c*); and the first jet flow increasing structure is configured to generate a negative pressure when the water from the fill valve (122) flows through the first gap (124*b*), so that the water in the cistern (120) flows into the first throat pipe (124*c*); and the second jet flow increasing structure comprises a second spray nozzle (126*a*) near the second water inlet end, a second throat pipe (126*c*) near the second water outlet end, and a second gap (126*b*) positioned between the second spray nozzle (126*a*) and the second throat pipe (126*c*); and the second jet flow increasing structure is configured to generate a negative pressure when the water from the fill valve (122) flows through the second gap (126*b*), so that the water in the cistern (120) flows into the second throat pipe (126*c*).

6. The toilet according to claim 1, wherein, the switching valve is disposed in a T-junction, and the fill valve (122), the first water inlet end of the first ring flushing pipeline (124) and the second water inlet end of the second bottom flushing pipeline (126) are respectively connected to the T-junction.

7. The toilet according to claim 4, wherein, a direction changing mechanism is further disposed in the cistern (120), and is configured to allow a jet water flow sprayed out from the second spray nozzle (126*a*) to be directly injected into the cistern (120) instead of flowing into the second throat pipe (126*c*) when the water level in the cistern (120) is lower than a first preset water level.

8. The toilet according to claim 2, wherein, a closing mechanism configured to close the flush valve (128) is further disposed in the cistern (120), and is configured to close the flush valve (128) when the water level in the cistern (120) is lower than a second preset water level.

9. The toilet according to claim 2, wherein, the toilet (100) comprises a flushing switch operated by a user, and the flushing switch is linked to a flushing actuating device (160) positioned in the cistern (120), such that the flushing actuating device (160) is configured to open the fill valve (122) and the flush valve (128) when being actuated by the flushing switch.

10. A toilet (100), comprising:

a seat body (110) with a sewage accommodating bowl, wherein the sewage accommodating bowl (112) comprises a sewage accommodating surface (114) and a sewage draining exit (115) positioned at the bowl bottom, and is provided with a ring flushing port opening (117); and a cistern (120), accommodating water for flushing the sewage accommodating bowl;

wherein the inside of the cistern (120) is provided with:

a fill valve (122), wherein water flows into the cistern (120) through the fill valve (122);

a flush valve (128);

a first ring flushing pipeline (124), wherein, in a first position, a first water inlet end of the first ring flushing pipeline (124) is selectively in fluid communication with the fill valve (122); a first water outlet end (124*d*) of the first ring flushing pipeline (124) is in fluid communication with the ring flushing port opening (117) so as to perform ring flushing on the sewage accommodating bowl (112); the first ring flushing pipeline (124) comprises a first jet flow increasing structure; and the first jet flow increasing structure is configured to generate a negative pressure when water from the fill valve (122) flows through the first jet flow increasing structure so as to suck the water in the cistern (120) into the first ring flushing pipeline (124);

a second bottom flushing pipeline (126), wherein, in a second position, a second water inlet end of the second bottom flushing pipeline (126) is selectively in fluid communication with the fill valve (122); a second water outlet end of the second bottom flushing pipeline (126) is in fluid communication with the flush valve (128) so as to enable water to flow to the sewage draining exit (115) through the flush valve (128) to perform bottom flushing on the sewage accommodating bowl (112); the second bottom flushing pipeline (126) comprises a second jet flow increasing structure; the second jet flow increasing structure is configured to generate a negative pressure when water from the fill valve (122) flows through the second jet flow increasing structure so as to suck the water in the cistern (120) into the second bottom flushing pipeline (126); and a pipeline switching mechanism configured to automatically switch between the first position and the second position in response to a water level in the cistern (120);

wherein the second jet flow increasing structure comprises a second spray nozzle (126*a*) near the second water inlet end, a second throat pipe (126*c*) near the second water outlet end, and a second gap (126*b*) positioned between the second spray nozzle (126*a*) and the second throat pipe (126*c*); the second jet flow increasing structure configured to generate a negative pressure when the water from the fill valve (122) flows through the second gap (126*b*), so that the water in the cistern (120) flows into the second throat pipe (126*c*); and wherein a direction changing mechanism is further disposed in the cistern (120), the direction changing mechanism configured to allow a jet water flow sprayed out from the second spray nozzle (126*a*) to be directly injected into the cistern (120) instead of flowing into the second throat pipe (126*c*) when the water level in the cistern (120) is lower than a first preset water level.

11. The toilet according to claim 10, wherein the pipeline switching mechanism comprises a floater type actuating device (129) and a switching valve (130), the floater type actuating device configured to drive the switching valve (130) to switch between the first position and the second position.

12. The toilet according to claim 11, wherein the switching valve is disposed in a T-junction, and the fill valve (122), the first water inlet end of the first ring flushing pipeline (124) and the second water inlet end of the second bottom flushing pipeline (126) are respectively connected to the T-junction.

13. A toilet (100), comprising:

a seat body (110) with a sewage accommodating bowl, wherein the sewage accommodating bowl (112) comprises a sewage accommodating surface (114) and a sewage draining exit (115) positioned at the bowl bottom, and is provided with a ring flushing port opening (117); and a cistern (120), accommodating water for flushing the sewage accommodating bowl;

wherein the inside of the cistern (120) is provided with:

a fill valve (122), wherein water flows into the cistern (120) through the fill valve (122);

a flush valve (128);

a first ring flushing pipeline (124), wherein, in a first position, a first water inlet end of the first ring flushing pipeline (124) is selectively in fluid communication with the fill valve (122); a first water outlet end (124*d*) of the first ring flushing pipeline (124) is in fluid communication with the ring flushing port opening (117) so as to perform ring flushing on the sewage accommodating bowl (112); the first ring flushing pipeline (124) comprises a first jet flow increasing structure; and the first jet flow increasing structure is configured to generate a negative pressure when water from the fill valve (122) flows through the first jet flow increasing structure so as to suck the water in the cistern (120) into the first ring flushing pipeline (124);

a second bottom flushing pipeline (126), wherein, in a second position, a second water inlet end of the second bottom flushing pipeline (126) is selectively in fluid communication with the fill valve (122); a second water outlet end of the second bottom flushing pipeline (126) is in fluid communication with the flush valve (128) so as to enable water to flow to the sewage draining exit (115) through the flush valve (128) to perform bottom flushing on the sewage accommodating bowl (112); the second bottom flushing pipeline (126) comprises a second jet flow increasing structure; the second jet flow increasing structure is configured to generate a negative pressure when water from the fill valve (122) flows through the second jet flow increasing structure so as to suck the water in the cistern (120) into the second bottom flushing pipeline (126); and a pipeline switching mechanism configured to automatically switch between the first position and the second position in response to a water level in the cistern (120), wherein, the first jet flow increasing structure comprises a first spray nozzle (124*a*) near the first water inlet end, a first throat pipe (124*c*) near the first water outlet end (124*d*), and a first gap (124*b*) positioned between the first spray nozzle (124*a*) and the first throat pipe (124*c*); and the first jet flow increasing structure is configured to generate a negative pressure when the water from the fill valve (122) flows through the first gap (124*b*), so that the water in the cistern (120) flows into the first throat pipe (124*c*);

the second jet flow increasing structure comprises a second spray nozzle (126*a*) near the second water inlet end, a second throat pipe (126*c*) near the second water outlet end, and a second gap (126*b*) positioned between the second spray nozzle (126*a*) and the second throat pipe (126*c*); and the second jet flow increasing structure is configured to generate a negative pressure when the water from the fill valve (122) flows through the second gap (126*b*), so that the water in the cistern (120) flows into the second throat pipe (126*c*); and a direction changing mechanism is further disposed in the cistern (120), the direction changing mechanism configured to allow a jet water flow sprayed out from the second spray nozzle (126*a*) to be directly injected into the cistern (120) instead of flowing into the second throat pipe (126*c*) when the water level in the cistern (120) is lower than a first preset water level.

14. The toilet according to claim 13, wherein the pipeline switching mechanism comprises a floater type actuating device (129) and a switching valve (130), the floater type actuating device configured to drive the switching valve (130) to switch between the first position and the second position.

15. The toilet according to claim 14, wherein the switching valve is disposed in a T-junction, and the fill valve (122), the first water inlet end of the first ring flushing pipeline (124) and the second water inlet end of the second bottom flushing pipeline (126) are respectively connected to the T-junction.

* * * * *